US010815026B2

(12) United States Patent
Qiu

(10) Patent No.: US 10,815,026 B2
(45) Date of Patent: Oct. 27, 2020

(54) DOUBLE-LAYER KEG

(71) Applicant: Changfu Qiu, Yuhuan (CN)

(72) Inventor: Changfu Qiu, Yuhuan (CN)

(73) Assignee: Talos Technology Corporation, Yuhan (CN)

( * ) Notice: Subject to any disclaimer, the term of this patent is extended or adjusted under 35 U.S.C. 154(b) by 95 days.

(21) Appl. No.: 16/159,612

(22) Filed: Oct. 13, 2018

(65) Prior Publication Data

US 2019/0375543 A1 Dec. 12, 2019

(30) Foreign Application Priority Data

Jun. 8, 2018 (CN) ..... 2018 1 0589137

(51) Int. Cl.

| | |
|---|---|
| ***B65D 81/18*** | (2006.01) |
| ***B65D 8/00*** | (2006.01) |
| ***B65D 25/24*** | (2006.01) |
| ***B65D 81/20*** | (2006.01) |
| ***B65D 85/72*** | (2006.01) |

(52) U.S. Cl.

CPC ..... *B65D 15/18* (2013.01); *B65D 25/24* (2013.01); *B65D 81/2015* (2013.01); *B65D 85/72* (2013.01)

(58) Field of Classification Search

CPC ..... B67D 2001/0822; B67D 1/0804; B67D 1/0801; B65D 81/2015; B65D 85/72; B65D 25/24; B65D 15/18; B65D 23/0885

See application file for complete search history.

(56) References Cited

U.S. PATENT DOCUMENTS

| | | | | |
|---|---|---|---|---|
| 4,573,603 | A | 3/1986 | Starling | |
| 4,690,299 | A | 9/1987 | Cannon | |
| 5,129,534 | A | 7/1992 | Dunn | |
| 5,657,871 | A | 8/1997 | Waters et al. | |
| 5,913,445 | A * | 6/1999 | Fujii | A47J 41/0077 220/574 |
| 5,915,595 | A | 6/1999 | Dow et al. | |
| 2004/0011828 | A1 | 1/2004 | Van Der Klaauw et al. | |
| 2010/0102087 | A1 | 4/2010 | Meike et al. | |

(Continued)

FOREIGN PATENT DOCUMENTS

| | | |
|---|---|---|
| CN | 105555673 A | 5/2016 |
| CN | 207209942 U | 4/2018 |

(Continued)

*Primary Examiner* — Stephen J Castellano
(74) *Attorney, Agent, or Firm* — Minder Law Group; Willy H. Wong

(57) ABSTRACT

A double-layer keg comprises an outer barrel and an inner barrel made of plastic disposed in the outer barrel. A bottom of the outer barrel is fixed with a base, and a lower portion of the outer barrel has a brace for supporting a bottom periphery of the inner barrel. A spear structure is installed at a barrel opening of the inner barrel, and an upper portion of the inner barrel has a shoulder and a neck disposed around the barrel opening. An inner surface of an upper portion of the outer barrel is pressed against an outer surface of the shoulder and/or the neck of the inner barrel. An expansion space, provided for the bottom of the inner barrel to expand downward, is disposed between a portion of the bottom of the inner barrel located at an inner side of the brace and the base.

16 Claims, 5 Drawing Sheets

(56) References Cited

U.S. PATENT DOCUMENTS

| | | | | |
|---|---|---|---|---|
| 2010/0264140 | A1 | 10/2010 | Apps | |
| 2011/0017737 | A1 | 1/2011 | Apps | |
| 2012/0121767 | A1 | 5/2012 | Hanssen | |
| 2012/0125938 | A1 | 5/2012 | Bates et al. | |
| 2012/0181289 | A1* | 7/2012 | Apps | B65D 39/086 220/592.19 |
| 2013/0206762 | A1 | 8/2013 | Smith et al. | |
| 2014/0034671 | A1 | 2/2014 | Chism et al. | |
| 2018/0237282 | A1* | 8/2018 | Luo | B67D 1/04 |

FOREIGN PATENT DOCUMENTS

| | | | |
|---|---|---|---|
| DE | 3725563 | A1 | 2/1989 |
| EP | 1947029 | A1 | 7/2008 |
| GB | 2203117 | A | 10/1988 |
| WO | WO0078665 | A1 | 12/2000 |
| WO | WO2010028707 | A1 | 3/2010 |
| WO | WO2011134949 | A1 | 11/2011 |
| WO | WO2016/131113 | A4 | 8/2016 |

* cited by examiner

DOUBLE-LAYER KEG

RELATED APPLICATIONS

This application claims priority to China Patent Application No. 201810589137.3 filed Jun. 8, 2018.

The applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

BACKGROUND OF THE INVENTION

Field of Invention

The present invention belongs to the technical field of liquor drinking devices and relates to a double-layer keg.

Related Art

Keg is a tool for holding liquor, generally divided into metal keg and plastic keg. The plastic keg has low cost and light weight, the transportation cost is greatly reduced, and has considerable advantages in moving and handling, thus plastic kegs are more and more widely used in the current market. Since the plastic keg is lower in strength than the metal keg, it is designed as a double-layer keg to protect the inner layer barrel through the outer layer barrel. For example, one prior art discloses a plastic keg including an outer barrel and an inner barrel of a plastic material, and high pressure air is required to be filled into the inner barrel when liquor is dispensed, and the liquor is squeezed out by the high pressure air. At the same time, in order to prevent the empty barrel from being squeezed and deformed during the transportation, it is also necessary to inject high-pressure air into the empty barrel, thereby forming a certain air pressure in the inner barrel. This is also to enable the inner barrel to fully expand and deform, and various portions of the inner barrel are fully expanded to eliminate stress concentration and make full contact with the outer barrel. However, the plastic barrel has a spear structure disposed at a barrel opening of the inner barrel, and the spear structure is connected to a barrel opening of the outer barrel, that is, the spear structure determines that a position of the barrel opening of the inner barrel is relatively fixed with a position of the barrel opening of the outer barrel, and there is a significant gap between an outer surface of a shoulder of the inner barrel and an inner surface of a shoulder of the outer barrel. When the inner barrel expands and deforms, the barrel opening of the inner barrel will be displaced upwardly, which may easily cause the barrel opening of the inner barrel to be separated from the spear structure, or the spear structure and the barrel opening of the outer barrel are separated to cause the spear structure to shift. These not only affect the installation stability of the spear structure, but also affect the matched installation of liquor dispensing devices such as a dispenser and the spear structure. Of course, such as in the plastic keg disclosed in another prior art, a larger space is provided above an inner barrel, and an upper portion of the inner barrel also expands and deforms upward under internal pressure, which will also cause displacement of a spear structure at an barrel opening of the inner barrel, affecting the matched connection with other liquor dispensing devices.

In view of the above technical deficiencies, due to the displacement of the spear structure is ultimately caused, technical personnel skilled in the art can easily think of strengthening the spear structure, such as increasing the connection strength between the spear structure and the outer barrel as well as the inner barrel. For example, the patent with application number 201480047167.1 discloses a container including an inner barrel and an outer barrel. It can be clearly seen from FIG. 2B that there is a space above a shoulder of the inner barrel, and when high pressure air is filled into the inner barrel, an upper portion of the inner barrel will also expand and deform upward. For this problem, paragraph 38 of the specification states that, the top of the casing also has a collar that extends around a valve member to protect the valve member. Paragraph 42 states that an inner diameter of the collar is smaller than an outer diameter of the valve member. As shown in conjunction with FIG. 2B, the valve member is wrapped by a lower portion of the collar, thereby improving the connection strength with the valve member, avoiding displacement of the valve member, etc. Although better connection stability is provided between the valve member and the outer barrel, due to the tremendous high pressure in the inner barrel, it is still easy to cause a split between a barrel opening edge of the inner barrel and the valve member to affect the connection stability.

SUMMARY OF THE INVENTION

One object of one embodiment of the present invention is to solve the above technical problems in the prior art by providing a double-layer keg for solving the problem of poor stability of installation of a spear structure during internal pressurization.

One object of one embodiment of the present invention can be achieved by the following technical solutions: A double-layer keg comprises an rigid outer barrel and an inner barrel made of plastic disposed in the outer barrel. A bottom of the outer barrel is fixed with a base, and a lower portion of the outer barrel has a brace for supporting a bottom periphery of the inner barrel. A spear structure is installed at a barrel opening of the inner barrel, and an upper portion of the inner barrel has a shoulder and a neck disposed around the barrel opening, wherein an inner surface of an upper portion of the outer barrel is pressed against an outer surface of the shoulder and/or the neck of the inner barrel, an expansion space is disposed between a portion of the bottom of the inner barrel located at an inner side of the brace and the base, and the expansion space is capable of allowing the bottom of the inner barrel to expand downward.

The outer barrel supports the inner barrel through the brace. Under the limitation of the brace, the outer barrel is pressed against the shoulder or the neck of the inner barrel, and of course, the outer barrel can also be pressed against the shoulder and the neck at the same time. Wherein the neck refers to a straight cylindrical portion at the barrel opening of the inner barrel, which is positioned higher than the shoulder, an outer diameter thereof is smaller than an outer diameter of a trunk of the inner barrel, and the shoulder is a portion between the trunk of the inner barrel and the neck, an arcuate and bent transition is between an outer periphery thereof and an upper end of the trunk, and an arcuate and bent transition is between an inner periphery thereof and a lower end of the neck, and an arcuate and bent portion at the inner periphery and the outer periphery of the shoulder should be understood as parts of the shoulder, enabling the inner barrel to be kept stable relative to the outer barrel. When the double-layer keg is transported as an empty barrel, inside of the inner barrel is inflated and pressurized, or the inner barrel is inflated and pressurized when liquor is dispensed, the inner barrel made of plastic material will undergo expansion and deformation. Since the expansion space is provided between the bottom of the inner barrel and the base, the expansion space is located at the inner side of the brace, the inner surface of the upper portion of the outer barrel is pressed against the outer surface of the shoulder of the inner barrel, and the shoulder is disposed around the barrel opening; so the bottom of the inner barrel will expand downward under internal pressure, and the shoulder of the inner barrel and a portion of the barrel opening at an inner side of the shoulder will not expand and deform upward, that is, the relative positions of the barrel opening of the inner barrel and the barrel opening of the outer barrel will not change. Therefore, the installation positions of both the barrel openings with the spear structure are stable, avoiding the unstable installation of the spear structure due to the change of the position of the barrel opening of the inner barrel, which causes the spear structure to be separated from the outer barrel or the inner barrel, and of course can also avoid the displacement of the spear structure relative to the position of the barrel opening of the outer barrel, which causes liquor dispensing devices such as a dispenser to be difficult to match during installation. Of course, when the inner surface of the outer barrel is pressed against the outer surface of the shoulder, since an outer diameter of an arcuate and bent portion at the lower end of the neck gradually becomes larger, the inner surface of the outer barrel can also limit a position of the inner barrel to prevent it from expanding and deforming upward.

In one embodiment of the above-mentioned double-layer keg, the outer surface of the shoulder is a flat surface, a tapered surface, or a first arcuate surface, and the inner surface of the outer barrel and the outer surface of the shoulder are fitted and pressed against each other. The shoulder is a joint between the trunk and the barrel opening of the inner barrel, and has the outer surface facing upward or obliquely upward, thus the outer barrel can have a downward or an obliquely downward positioning limitation on the shoulder. The surface contact and pressing between the surfaces of the shoulder and the outer barrel also makes the entire shoulder in a stable state, which can block the expansion and deformation of other portions of the inner barrel from being transferred to the inner side of the shoulder, thereby avoiding the change of the position of the barrel opening of the inner barrel under internal pressure.

In one embodiment of the above-mentioned double-layer keg, both the outer barrel and the inner barrel each has a straight cylindrical trunk, and an inner surface of the trunk of the outer barrel and an outer surface of the trunk of the inner barrel are fitted with each other. The straight cylindrical trunk of the inner barrel causes the inner barrel to expand in an axial direction, and, in conjunction with the fitted disposition between the outer surface of the inner barrel and the inner surface of the outer barrel, causes the inner barrel can only expand and deform through the bottom thereof in a direction toward the expansion space, preventing expansion and deformation at the barrel opening of the inner barrel or the upper portion of the inner barrel, so that the upper portion of the inner barrel and the upper portion of the outer barrel are kept relatively stable with each other.

In one embodiment of the above-mentioned double-layer keg, both the outer barrel and the inner barrel each has a straight cylindrical trunk, and a gap with a width of less than 5 mm is disposed between an inner surface of the trunk of the outer barrel and an outer surface of the trunk of the inner barrel. The gap between the trunk of the outer barrel and the trunk of the inner barrel is used for a radial expansion of the inner barrel, so that the inner barrel is fully expanded and uniformly contacted with the inner surface of the outer barrel, thereby avoiding local stress concentration and burst of the inner barrel and results in bursting. Of course, since the shoulder of the inner barrel is pressed and limited by the outer barrel, the radial expansion of the inner barrel will not be transferred to the barrel opening.

In one embodiment of the above-mentioned double-layer keg, the brace is formed by a radial contraction of the lower portion of the outer barrel, the brace is in an annular shape, the brace has an upwardly inclined abutment and a downwardly inclined brace surface, and the abutment and the bottom periphery of the inner barrel are abutted against each other. The brace is formed by the radial contraction, that is, an inner side thereof is radially inwardly protruded, an outer side thereof is radially inwardly recessed, and the brace is circumferentially annularly disposed, thus the brace functions as a stiffener, and a strength of the lower portion of the outer barrel can be made higher, avoiding deformation under the gravity and expansion force of the inner barrel. The inclined brace surface can better support the abutment, and the abutment is obliquely disposed, thus when the trunk of the inner barrel expands and deforms downward, the bottom periphery of the inner barrel can slide downward relative to the abutment to realize the expansion and deformation of the bottom of the inner barrel.

In one embodiment of the above-mentioned double-layer keg, the outer surface of the trunk of the inner barrel and an outer surface of the bottom of the inner barrel are joined by a second arcuate surface, and the inner barrel abuts against the abutment of the brace through the second arcuate surface. When the trunk of the inner barrel expands and deforms downward, the second arcuate surface is more conducive for sliding relative to the abutment, so that the bottom of the inner barrel expands and deforms.

In one embodiment of the above-mentioned double-layer keg, the bottom of the inner barrel is in an arcuate shape, and a middle portion of the bottom of the inner barrel is lower than the brace. The arcuate bottom of the inner barrel can guide the expansion and deformation, so that the bottom preferentially exhibits downward expansion and deformation when the pressure inside the inner barrel becomes larger.

In one embodiment of the above-mentioned double-layer keg, the base has an annular slot in a circumferential direction, an opening of the slot faces upward, a lower end edge of the outer barrel is inserted downwardly in the slot, and an outer surface of the lower end of the outer barrel is tightly fitted with a slot wall of the slot of the base. The lower end edge of the outer barrel is inserted and positioned in the slot of the base to achieve the relative connection between the two. If the expansion space is insufficient and causes the trunk of the inner barrel to expand and deform and abut against the base, since the outer barrel is inserted downwardly and connected to the base by tight fitting in place, thus the outer barrel can displace upward loosely relative to the base, thereby the expansion space becomes larger, so that the inner barrel expands fully to eliminate stress concentration.

Compared with the prior art, one embodiment of the double-layer keg has the following advantages:

1. Since the expansion space is provided between the bottom of the inner barrel and the base, and the inner surface of the upper portion of the outer barrel is pressed against the outer surface of the shoulder of the inner barrel, so the bottom of the inner barrel will expand downward under internal pressure, and the shoulder of the inner barrel and a portion of the barrel opening at an inner side of the shoulder will not expand and deform upward, that is, the relative positions of the barrel opening of the inner barrel and the barrel opening of the outer barrel will not change. Therefore, the installation positions of both the barrel openings with the spear structure are stable, avoiding the unstable installation of the spear structure due to the change of the position of the barrel opening of the inner barrel, which causes the spear structure to be separated from the outer barrel or the inner barrel.

2. Since the shoulder of the inner barrel is limited by the pressing of the outer barrel, it is avoided that, due to the displacement of the spear structure relative to the position of the barrel opening of the outer barrel, liquor distribution devices such as a dispenser become difficult to match during the installation.

3. Since the outer barrel is inserted downwardly, that is, there is an assembly gap between the outer barrel and the base, so if the expansion space is insufficient and causes the trunk of the inner barrel to expand and deform and abut against the base, the outer barrel can displace upward loosely relative to the base, thereby the expansion space becomes larger, so that the inner barrel expands fully to eliminate stress concentration.

DETAILED DESCRIPTION OF THE INVENTION

The technical solutions of the present invention are further described below with reference to the specific embodiments of the present invention in conjunction with the accompanied drawings, but the present invention is not limited to these embodiments.

Embodiment 1

Figure 1:
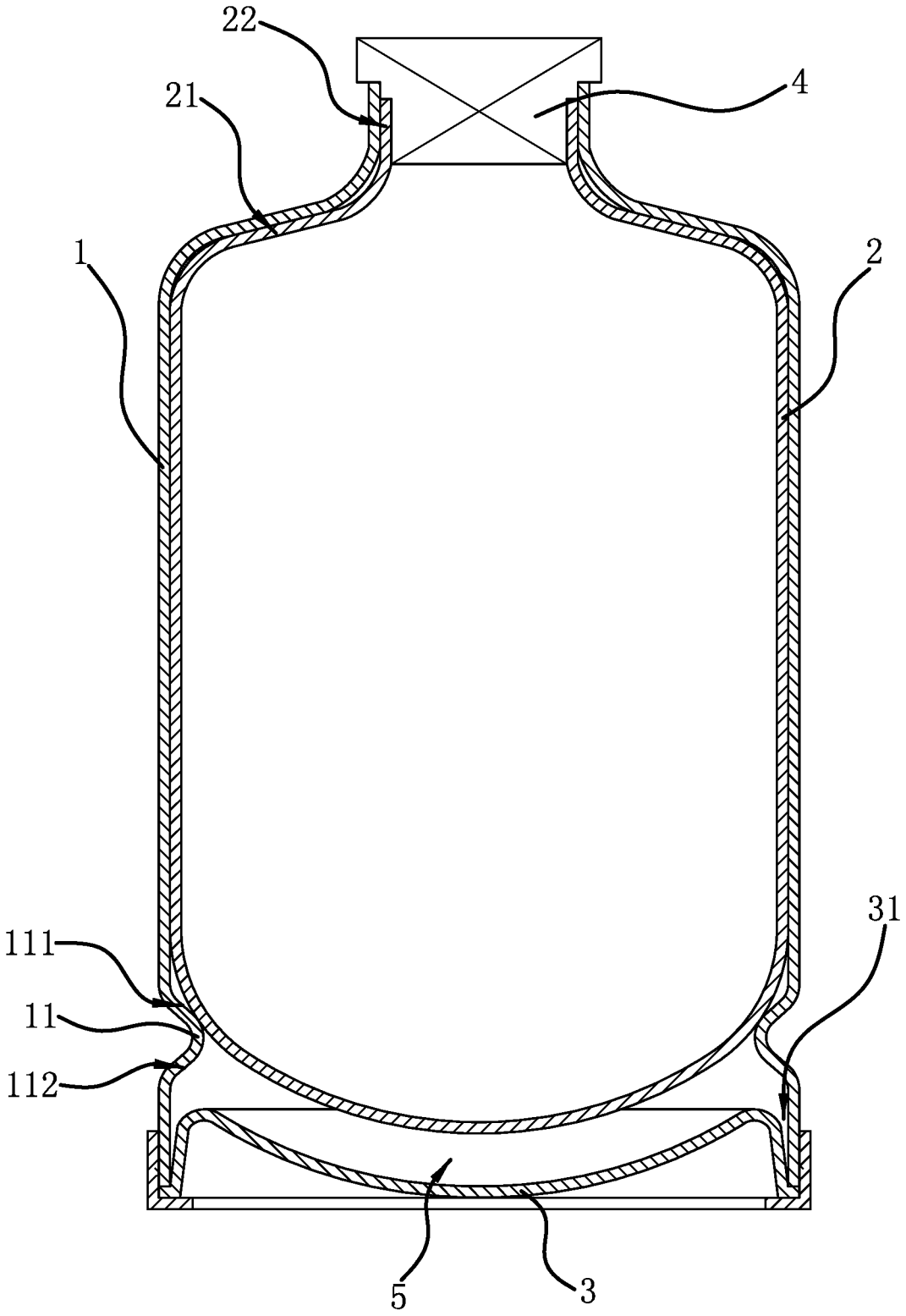
FIG. 1 is a cross-sectional view of a first embodiment of a double-layer keg.
Figure 2:
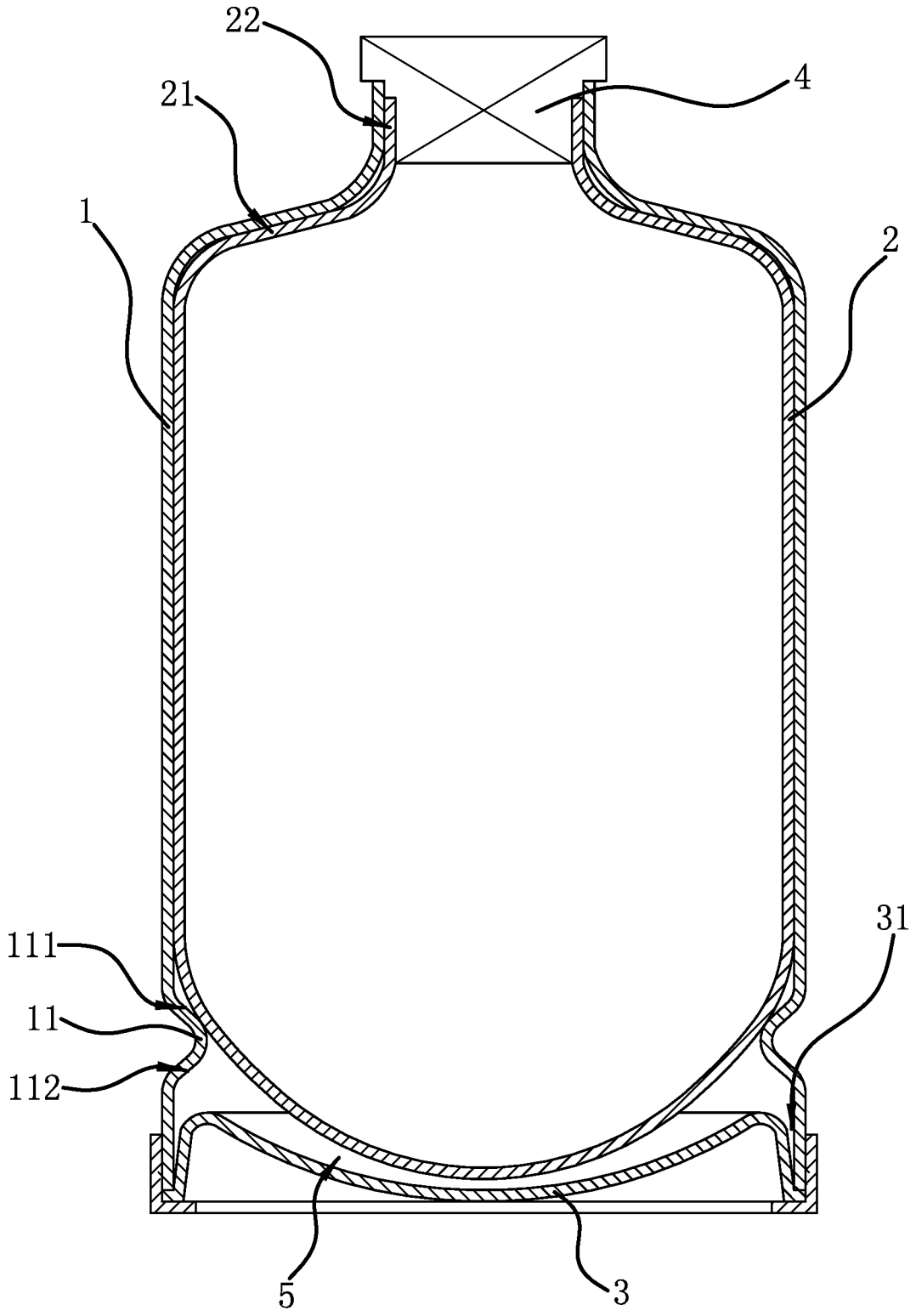
FIG. 2 is a cross-sectional view of a bottom of one embodiment of an inner barrel in the double-layer keg when the bottom is expanded and deformed downwardly.

As shown in FIG. 1 and FIG. 2, one embodiment of a double-layer keg comprises an outer barrel 1 and an inner barrel 2, both of which are made of PET material, the inner barrel 2 is located inside the outer barrel 1, the outer barrel 1 is some rigidity for supporting the inner barrel 2. a lower end of the outer barrel 1 is penetrated, and a base 3 is fixed at a bottom of the outer barrel 1. The inner barrel 2 comprises a neck 22, a shoulder 21 and a trunk, the neck 22 is in a straight cylindrical shape, and an upper end port of the neck 22 is a barrel opening. A spear structure 4 is installed at the barrel opening of the inner barrel 2 for connecting liquor dispensing devices such as a dispenser. The shoulder 21 is disposed around the barrel opening, and an outer surface thereof is a tapered surface. Of course, the outer surface of the shoulder 21 can also be an annular flat surface, or a first arcuate surface. Corners between the shoulder 21 and the neck 22 as well as between the shoulder 21 and the trunk are arcuately designed, and there can be a gap between the outer surface of the shoulder 21 at the corner positions and an inner surface of the outer barrel 1 at the corner positions. Because the corner design has a higher strength, it does not exhibit expansion and deformation under the effect of internal pressure. Of course, the outer surface of the inner barrel 2 at the corner positions can be fitted to the inner surface of the outer barrel 1 at the corner positions, and the trunk of the inner barrel 2 is also in a straight cylindrical shape, and a height thereof is 1.66 times or more of its diameter. An inner surface of the trunk of the outer barrel 1 and an outer surface of the trunk of the inner barrel 2 are fitted with each other. An inner surface of an upper portion of the outer barrel 1 is fitted and pressed against the outer surface of the shoulder 21 and an outer surface of the neck 22. A lower portion of the outer barrel 1 has a brace 11, and a bottom periphery of the inner barrel 2 abuts against the brace 11, that is, the outer barrel 1 supports the inner barrel 2 through the brace 11. An expansion space 5 is disposed between a portion of the bottom of the inner barrel 2 located at an inner side of the brace 11 and the base 3, and the expansion space 5 is capable of allowing the bottom of the inner barrel 2 to expand downward.

One embodiment of the brace 11 is formed by a radial contraction of the lower portion of the outer barrel 1, the brace 11 is in an annular shape, and the brace 11 has an upwardly inclined abutment 111 and a downwardly inclined brace surface 112. The outer surface of the trunk of the inner barrel 2 and an outer surface of the bottom of the inner barrel 2 are joined by a second arcuate surface, and the inner barrel 2 abuts against the abutment 111 of the brace 11 through the second arcuate surface. When the trunk of the inner barrel 2 expands and deforms downward, the second arcuate surface is more conducive for sliding relative to the abutment 111, so that the bottom of the inner barrel 2 expands and deforms downward. The bottom of the inner barrel 2 is in an arcuate shape, and a middle portion of the bottom of the inner barrel 2 is lower than the brace 11. The base 3 has an annular slot 31 in a circumferential direction, an opening of the slot 31 faces upward, a lower end edge of the outer barrel 1 is inserted downwardly in the slot 31, and an outer surface of the lower end of the outer barrel 1 is tightly fitted with a slot wall of the slot 31 of the base 3. If the expansion space 5 is insufficient and causes the trunk of the inner barrel 2 to expand and deform and abut against the base 3, since the outer barrel 1 is inserted downwardly and connected to the base 3 by tight fitting in place, thus the outer barrel 1 can displace upward loosely relative to the base 3, thereby the expansion space 5 becomes larger, so that the inner barrel 2 expands fully to eliminate stress concentration.

Embodiment 2

Figure 3:
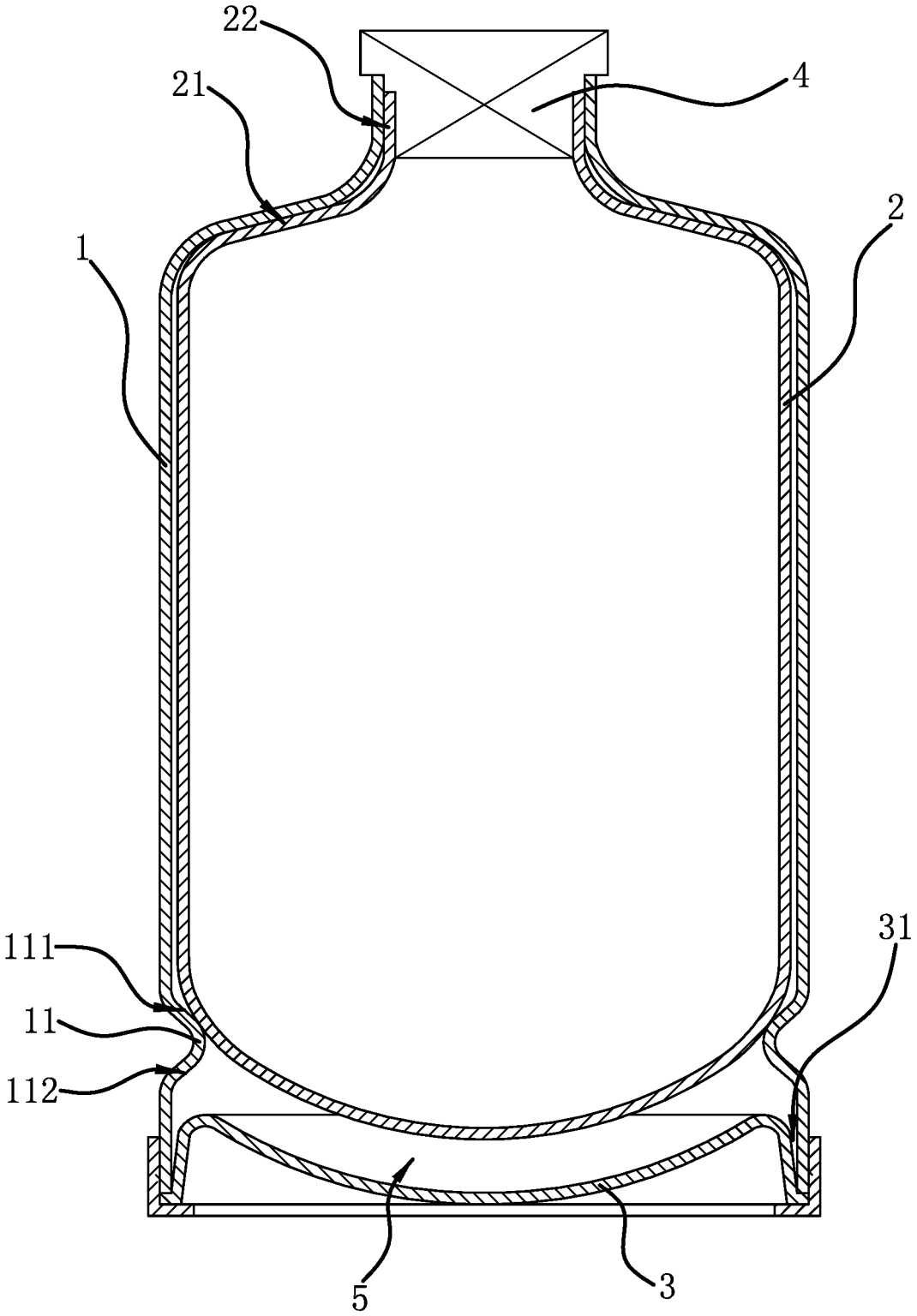
FIG. 3 is a cross-sectional view of a second embodiment of the double-layer keg.

The structure of the double-layer keg is basically the same as that of the first embodiment. The differences lie in, as shown in FIG. 3, a gap with a width of less than 5 mm is disposed between the inner surface of the trunk of the outer barrel 1 and the outer surface of the trunk of the inner barrel 2. The gap is used for a radial expansion of the inner barrel 2, so that the inner barrel 2 is fully expanded and uniformly contacted with the inner surface of the outer barrel 1, thereby avoiding local stress concentration and burst of the inner barrel 2 and results in bursting.

Embodiment 3

Figure 4:
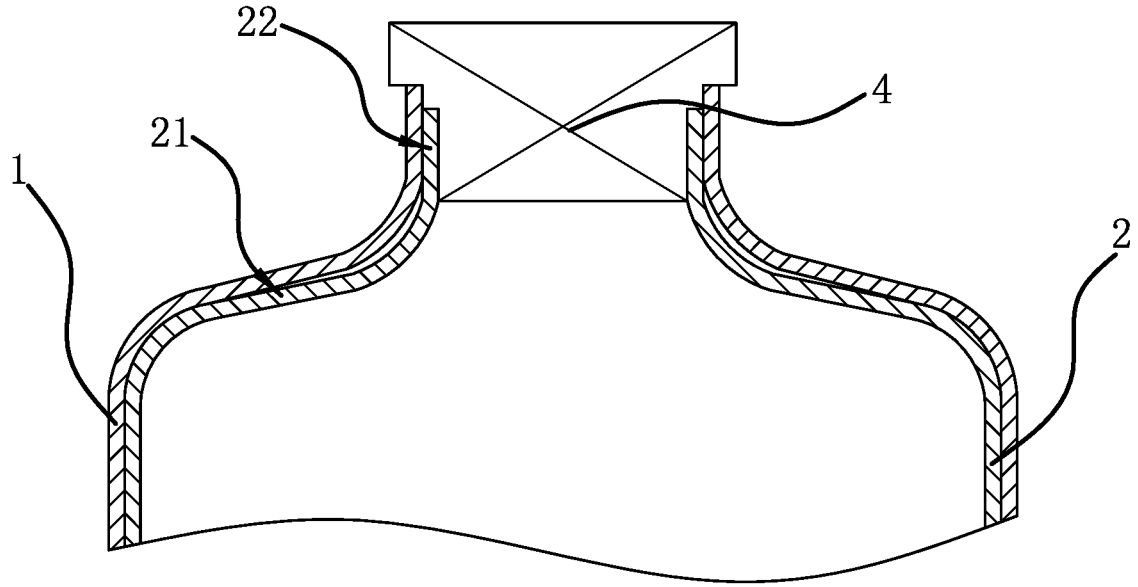
FIG. 4 is a cross-sectional partial view of a third embodiment of the double-layer keg.

The structure of the double-layer keg is basically the same as that of the first embodiment. The differences lie in, as shown in FIG. 4, the inner surface of the outer barrel 1 is simultaneously pressed against the outer surfaces of the shoulder 21 and the neck 22 of the inner barrel 2. Wherein, at the position of the shoulder 21, the inner surface of the outer barrel 1 is pressed against an arcuate and bent portion at an outer periphery of the shoulder 21 of the inner barrel 2, and there is still a certain gap above other positions of the shoulder 21 of the inner barrel 2, at this time, the outer barrel 1 can limit a position of the inner barrel 2 by pressing against the neck 22 and the arcuate and bent portion at the outer periphery of the shoulder 21 of the inner barrel 2, thereby preventing the inner barrel 2 from expanding and deforming upward.

Embodiment 4

Figure 5:
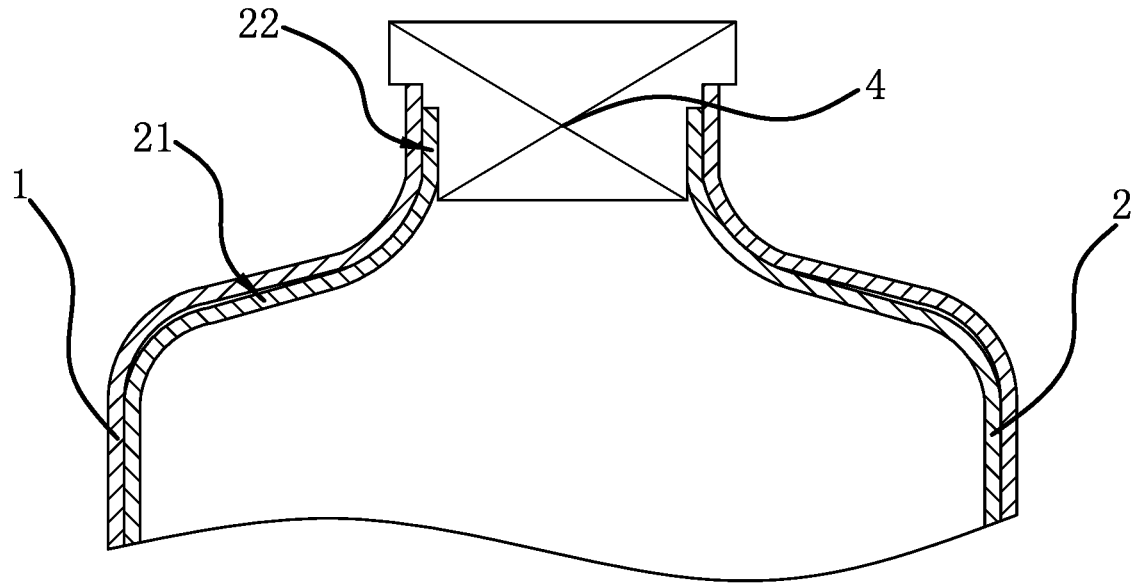
FIG. 5 is a cross-sectional partial view of a fourth embodiment of the double-layer keg.

The structure of the double-layer keg is basically the same as that of the first embodiment. The differences lie in, as shown in FIG. 5, the inner surface of the outer barrel 1 is simultaneously pressed against the outer surfaces of the shoulder 21 and the neck 22 of the inner barrel 2. Wherein, at the position of the shoulder 21, the inner surface of the outer barrel 1 is pressed against an arcuate and bent portion at an inner periphery of the shoulder 21 of the inner barrel 2, and there is still a certain gap above other positions of the shoulder 21 of the inner barrel 2, at this time, the outer barrel 1 can limit a position of the inner barrel 2 by pressing against the neck 22 and the arcuate and bent portion at the inner periphery of the shoulder 21 of the inner barrel 2, thereby preventing the inner barrel 2 from expanding and deforming upward.

Embodiment 5

Figure 6:
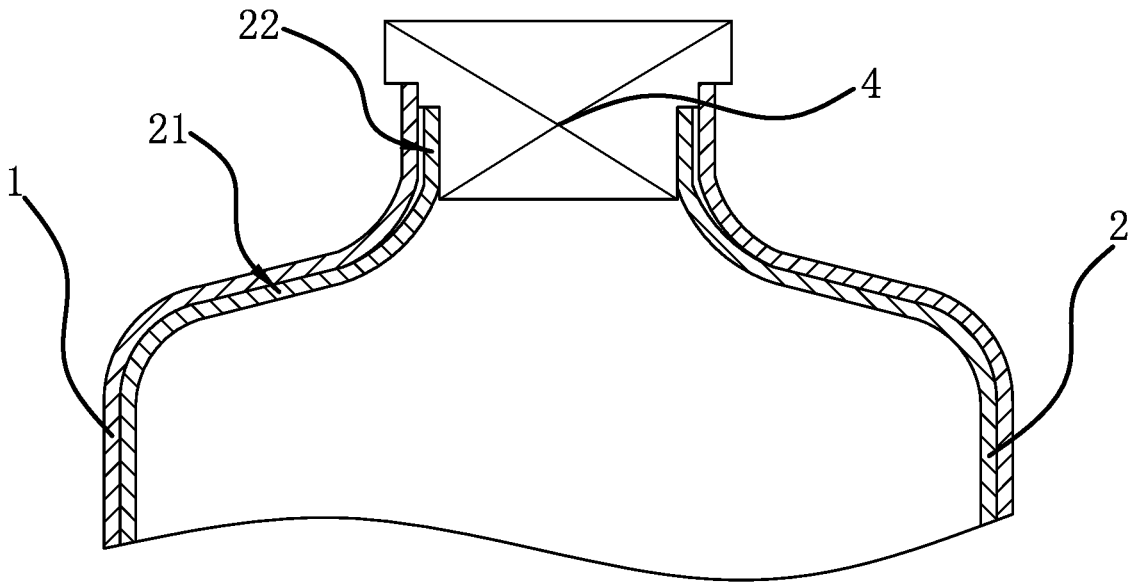
FIG. 6 is a cross-sectional partial view of a fifth embodiment of the double-layer keg.

The structure of the double-layer keg is basically the same as that of the first embodiment. The differences lie in, as shown in FIG. 6, the inner surface of the outer barrel 1 is only pressed against the outer surface of the shoulder 21 of the inner barrel 2, and there is a certain gap between the outer surface of the neck 22 of the inner barrel 2 and the inner surface of the outer barrel 1. At this time, the outer barrel 1 can limit a position of the inner barrel 2 by pressing against the shoulder 21 of the inner barrel 2, thereby preventing the inner barrel 2 from expanding and deforming upward.

Embodiment 6

Figure 7:
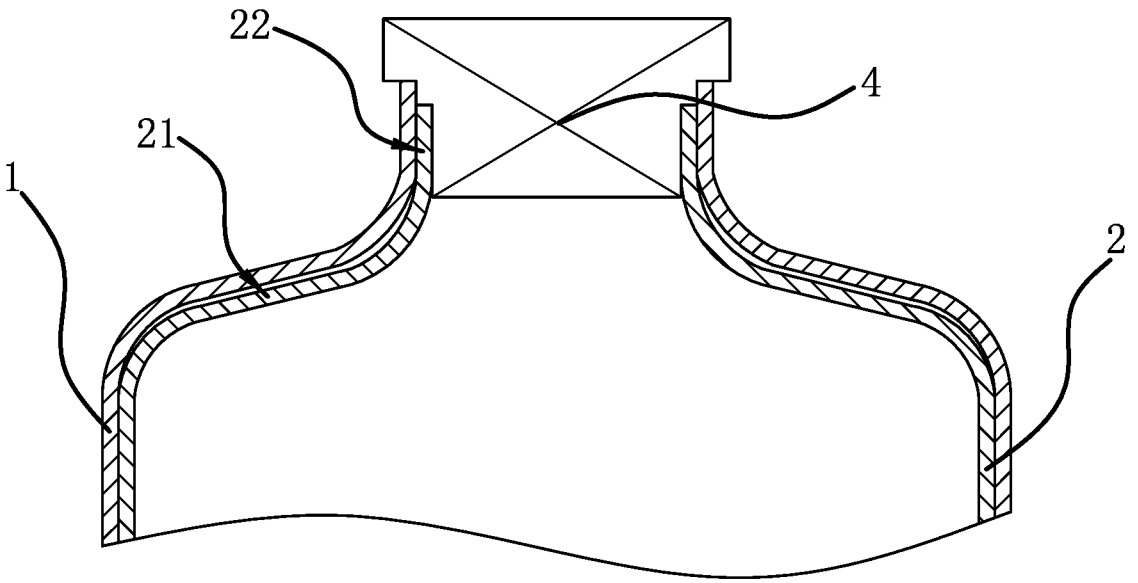
FIG. 7 is a cross-sectional partial view of a sixth embodiment of the double-layer keg.

The structure of the double-layer keg is basically the same as that of the first embodiment. The differences lie in, as shown in FIG. 7, the inner surface of the outer barrel 1 is only pressed against the outer surface of the neck 22 of the inner barrel 2, and there is a certain gap between the outer surface of the shoulder 21 of the inner barrel 2 and the inner surface of the outer barrel 1. At this time, an outer diameter of an arcuate and bent portion at the lower end of the neck 22 of the inner barrel 2 gradually becomes larger, thus can also limit a position of the inner barrel 2 to prevent the inner barrel 2 from expanding and deforming upward.

The specific embodiments described herein are merely illustrative of the spirit of the present invention. Technical personnel skilled in the art to which the present invention pertains can make various modifications or additions to the specific embodiments described or replace them in a similar manner, without departing from the spirit of the present invention or beyond the scope defined by the appended claims.

Although the terms outer barrel 1, brace 11, abutment 111, and the like are used more frequently herein, the possibility of using other terms is not excluded. These terms are merely used to describe and explain the nature of the present invention more conveniently; construing them as any of the additional restrictions is contrary to the spirit of the present invention.

LIST OF REFERENCED PARTS

1 outer barrel
11 brace
111 abutment
112 brace surface
2 inner barrel
21 shoulder
22 neck
3 base
31 slot
4 spear structure
5 expansion space

What is claimed is:

1. A double-layer keg, comprising:

a rigid outer barrel, the outer barrel having an outer barrel upper portion, an outer barrel lower portion, and an outer barrel bottom;

a brace on an inner surface of the outer barrel lower portion, and the outer barrel bottom being fixed with a base;

an inner barrel made of plastic disposed in the outer barrel, the inner barrel having an inner barrel opening at an inner barrel upper portion, the inner barrel having an inner barrel bottom;

a shoulder and a neck of the inner barrel disposed around the inner barrel opening; and a spear structure being installed at the inner barrel opening;

wherein an inner surface of the outer barrel upper portion is pressed against an outer surface of the shoulder and/or the neck of the inner barrel;

wherein a bottom periphery of the inner barrel is supported by the brace of the outer barrel;

wherein an expansion space is disposed between the base and a middle portion of the inner barrel bottom, the middle portion located at an inner side of the brace, and the expansion space is capable of allowing the inner barrel bottom to expand downward;

wherein the base has an annular slot in a circumferential direction, a lower end edge of the outer barrel is inserted downwardly in the slot: and wherein the expansion space is capable of being adjusted by changing a depth of the outer barrel in the slot through a downward expansion of the inner barrel.

2. The double-layer keg as claimed in claim 1, wherein the outer surface of the shoulder is a flat surface, a tapered surface, or a first arcuate surface, and the inner surface of the outer barrel and the outer surface of the shoulder are fitted and pressed against each other.

3. The double-layer keg as claimed in claim 2, wherein both the outer barrel and the inner barrel each has a straight cylindrical trunk, and an inner surface of the trunk of the outer barrel and an outer surface of the trunk of the inner barrel are fitted with each other.

4. The double-layer keg as claimed in claim 3, wherein an opening of the slot faces upward, and an outer surface of the lower end of the outer barrel is tightly fitted with a slot wall of the slot of the base.

5. The double-layer keg as claimed in claim 2, wherein both the outer barrel and the inner barrel each has a straight cylindrical trunk, and a gap with a width of less than 5 mm is disposed between an inner surface of the trunk of the outer barrel and an outer surface of the trunk of the inner barrel.

6. The double-layer keg as claimed in claim 5, wherein an opening of the slot faces upward, and an outer surface of the lower end of the outer barrel is tightly fitted with a slot wall of the slot of the base.

7. The double-layer keg as claimed in claim 2, wherein the brace is formed by a radial contraction of the outer barrel lower portion, the brace is in an annular shape, the brace has an upwardly inclined abutment and a downwardly inclined brace surface, and the abutment and the bottom periphery of the inner barrel are abutted against each other.

8. The double-layer keg as claimed in claim 7, wherein the outer surface of the trunk of the inner barrel and an outer surface of the inner barrel bottom are joined by a second arcuate surface, and the inner barrel abuts against the abutment of the brace through the second arcuate surface.

9. The double-layer keg as claimed in claim 8, wherein the inner barrel bottom is in an arcuate shape, and a middle portion of the inner barrel bottom is lower than the brace.

10. The double-layer keg as claimed in claim 2, wherein an opening of the slot faces upward, and an outer surface of the lower end of the outer barrel is tightly fitted with a slot wall of the slot of the base.

11. The double-layer keg as claimed in claim 1, wherein the brace is formed by a radial contraction of the outer barrel lower portion, the brace is in an annular shape, the brace has an upwardly inclined abutment and a downwardly inclined brace surface, and the abutment and the bottom periphery of the inner barrel are abutted against each other.

12. The double-layer keg as claimed in claim 11, wherein the outer surface of the trunk of the inner barrel and an outer surface of the inner barrel bottom are joined by a second arcuate surface, and the inner barrel abuts against the abutment of the brace through the second arcuate surface.

13. The double-layer keg as claimed in claim 12, wherein the inner barrel bottom is in an arcuate shape, and a middle portion of the inner barrel bottom is lower than the brace.

14. The double-layer keg as claimed in claim 1, wherein both the outer barrel and the inner barrel each has a straight cylindrical trunk, and an inner surface of the trunk of the outer barrel and an outer surface of the trunk of the inner barrel are fitted with each other.

15. The double-layer keg as claimed in claim 1, wherein both the outer barrel and the inner barrel each has a straight cylindrical trunk, and a gap with a width of less than 5 mm is disposed between an inner surface of the trunk of the outer barrel and an outer surface of the trunk of the inner barrel.

16. The double-layer keg as claimed in claim 1, wherein an opening of the slot faces upward, and an outer surface of the lower end of the outer barrel is tightly fitted with a slot wall of the slot of the base.

* * * * *